US008322171B2

(12) United States Patent
Sung

(10) Patent No.: US 8,322,171 B2
(45) Date of Patent: Dec. 4, 2012

(54) DRUM WASHING MACHINE WITH SUPPORTING HINGES

(75) Inventor: Jong Hun Sung, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 641 days.

(21) Appl. No.: 12/007,899

(22) Filed: Jan. 16, 2008

(65) Prior Publication Data

US 2008/0245112 A1 Oct. 9, 2008

(30) Foreign Application Priority Data

Apr. 5, 2007 (KR) ..... 10-2007-0033514

(51) Int. Cl.
*D06F 37/28* (2006.01)
*D06F 39/14* (2006.01)

(52) U.S. Cl. ..... 68/196

(58) Field of Classification Search ..... 68/3 R, 68/196; 16/333, 343, 347, 378, 379
See application file for complete search history.

(56) References Cited

U.S. PATENT DOCUMENTS

| | | | | |
|---|---|---|---|---|
| 5,187,837 | A * | 2/1993 | Gunderson et al. | 16/375 |
| 5,496,104 | A * | 3/1996 | Arnold et al. | 312/204 |
| 5,881,576 | A * | 3/1999 | Davies, Jr. | 68/3 R |
| 6,938,444 | B2 * | 9/2005 | Hong et al. | 68/196 |
| 7,617,570 | B2 * | 11/2009 | Hill | 16/347 |
| 2003/0172692 | A1 * | 9/2003 | Hong et al. | 68/139 |
| 2004/0107741 | A1 * | 6/2004 | Kim et al. | 68/24 |
| 2005/0194875 | A1 | 9/2005 | Reed et al. | |
| 2006/0101873 | A1 * | 5/2006 | Kim et al. | 68/196 |
| 2006/0254320 | A1 * | 11/2006 | Park et al. | 68/4 |

FOREIGN PATENT DOCUMENTS

| | | | |
|---|---|---|---|
| CN | 2837338 | | 11/2006 |
| DE | 90 14 378 | | 12/1990 |
| DE | 697 19 679 | | 12/2003 |
| DE | 10 2004 060 422 | | 6/2006 |
| EP | 844352 | A1 * | 5/1998 |
| GB | 2075109 | A * | 11/1981 |
| WO | WO 03057971 | A1 * | 7/2003 |
| WO | 2005/042891 | | 5/2005 |

OTHER PUBLICATIONS

Extended European Search Report for corresponding European application 08150361.7-2314; Nov. 19, 2009.
Chinese Office Action for corresponding Chinese application 200810003853.5; issued Nov. 20, 2009.

* cited by examiner

*Primary Examiner* — Joseph L Perrin
(74) *Attorney, Agent, or Firm* — Staas & Halsey LLP

(57) ABSTRACT

Disclosed is a drum washing machine, which improves structures of hinge units to rotatably support a door to easily assemble a door with a housing, and firmly endures a load of the door. The drum washing machine includes a housing provided with an opening through which laundry is put into the washing machine; a door connected to the housing to open and close the opening; a first hinge unit rotatably connecting the door to the housing; and a second hinge unit separated from the first hinge unit to rotatably support the door together with the first hinge unit. The second hinge unit causes the door to be supported on the housing. Through the above constitution, a worker may easily assemble the door with the housing, thus increasing a working efficiency.

14 Claims, 5 Drawing Sheets

DRUM WASHING MACHINE WITH SUPPORTING HINGES

CROSS-REFERENCE TO RELATED APPLICATIONS

This application claims the benefit of Korean Patent Application No. 2007-0033514, filed Apr. 5, 2007, in the Korean Intellectual Property Office, the disclosure of which is incorporated herein by reference.

BACKGROUND

1. Field

The present invention relates to a drum washing machine, and more particularly, to a drum washing machine, which allows a door to be easily assembled with a housing and firmly endures a load of the door.

2. Description of the Related Art

Generally, drum washing machines are apparatuses that wash laundry using a head of water obtained by rotating a drum. Each of the drum washing machines includes a housing forming an external appearance of the washing machine, a tub installed in the housing to contain water, a drum rotatably installed in the tub to contain laundry, and a driving motor to generate a rotary force of the drum.

An opening through which the laundry is put into the drum is formed through a front surface of the housing, and a door rotated to open and close the opening is hinged to one side of the front surface of the housing. Further, in order to improve the external appearance of the washing machine, the front surface of the housing is sunken so that the door can be inserted to a designated depth.

A hinge member to rotatably support the door is provided between the door and the housing. One side of the hinge member is connected to a central portion of a side surface of the door, and the other side of the hinge member is connected to the housing. That is, the hinge member is provided with a hinge protrusion provided at one side thereof and installed on a rotary axis of the door, a hinge hanger provided at the other side thereof and connected to the housing, and a hinge body connecting the hinge protrusion and the hinge hanger.

The door is installed on the front surface of the housing, and thus exerts a great influence on the design of the drum washing machine. In designing the drum washing machine, the door may have an increased size or an increased weight. In this case, all the load of the door is applied to the hinge member to rotatably support the door. Then, the hinge member, which is provided on the central portion of the side surface of the door, may be twisted by the load of the door.

Here, in the case that the hinge member has a weak rigidity, the hinge member may be deformed, and the door will tilt and cannot be smoothly opened and closed. Further, when torsion is continuously transferred to the hinge member, the hinge member will be broken.

In order to assemble the door with the housing, the hinge hanger of the hinge member needs to be fixed to the housing. However, in the case that the door has an increased size or an increased weight, it is difficult to assemble the door with the housing.

SUMMARY

Therefore, one aspect of the embodiment is to provide a drum washing machine, which improves the structures of hinge units to rotatably support a door to easily assemble the door with a housing and firmly endure the load of the door.

Another aspect of the embodiment is to provide a drum washing machine, which improves the structures of hinge units to restrict the opening angle of a door, thus preventing the door from being broken due to a collision with a housing.

Additional aspects and/or advantages will be set forth in part in the description which follows and, in part, will be apparent from the description, or may be learned by practice of the invention.

The foregoing and/or other aspects are achieved by providing a drum washing machine including a housing provided with an opening through which laundry is put into the washing machine; a door connected to the housing to open and close the opening; a first hinge unit rotatably connecting the door to the housing; and a second hinge unit separated from the first hinge unit rotatably supporting the door together with the first hinge unit. The second hinge unit causes the door to be supported on the housing.

The first hinge unit may be provided at a side of the door, and the second hinge unit may be provided below the first hinge unit.

The second hinge unit may include a second hinge protrusion provided on a lower surface of the door, and a second hinge hole provided in the housing to support the second hinge protrusion inserted thereinto such that the door is able to be supported on the housing.

An inner diameter of the second hinge hole may be increased from a lower portion thereof to an upper portion thereof so that the door can be tilted when being attached to the housing by inserting the second hinge protrusion into the second hinge hole.

The first hinge unit may include first hinge protrusions connected to a rotary axis of the door, first hinge bodies connected to the first hinge protrusions and fixed to the housing, first hinge hangers fixing the first hinge bodies to the housing, and first hinge holes formed in the door to support the first hinge protrusions inserted thereinto.

The foregoing and/or other aspects are achieved by providing a drum washing machine including a housing; a door connected to the housing to be rotatable; a first hinge unit rotatably supporting the door; and a second hinge unit rotatably supporting the door together with the first hinge unit, wherein at least one of the first hinge unit and the second hinge unit includes an opening restriction unit restricting an opening angle of the door.

The opening restriction unit may include at least one of a first opening restriction unit and a second opening restriction unit, the first and second opening restriction units respectively restricting the opening angle of the door within different ranges.

The first opening restriction unit may be provided at a side of the door and includes first opening restriction members provided on the door and first hinge bodies provided on the first hinge unit, and the first opening restriction members may contact the first hinge bodies to restrict the opening angle of the door when the door is opened at a designated angle.

The second hinge unit may include a second hinge protrusion provided on a rotary axis of the door and a second hinge hole supporting the second hinge protrusion inserted thereinto, and the second opening restriction unit may include a second opening restriction member provided adjacent to the second hinge protrusion to restrict the opening angle of the door and a second hinge hanger provided in the second hinge hole to contact the second opening restriction member when the door is rotated.

The second opening restriction member may be formed integrally with the second hinge protrusion, and the second hinge hanging member may be formed integrally with the second hinge hole.

The first opening restriction unit may restrict the opening angle of the door to a designated angle, and when the door is opened at the designated angle, there may be a designated interval between the second opening restriction member and the second hinge hanger.

A drum washing machine, including: a housing provided with an opening through which laundry is put into the washing machine to be washed; a door connected to the housing to open and close the opening; a first hinge unit rotatably connecting the door to the housing at an upper end of the door and rotatably supporting the door; and a second hinge unit rotatably supporting a lower surface of the door.

The drum washing machine may further include at least one opening restriction unit provided at at least one of the first hinge unit and the second hinge unit, the at least one opening restriction unit restricting an opening angle of the door.

The at least one opening restriction unit may include a first opening restriction unit and a second opening restriction unit, the first opening restriction unit and the second opening restriction unit sequentially restricting the opening angle of the door.

The first opening restriction unit may restrict the opening angle of the door to a designated angle and the second opening restriction unit may restrict the opening angle of the door when a user forces the door to open to more than the designated angle so that the door is prevented from colliding with the housing.

BRIEF DESCRIPTION OF THE DRAWINGS

These and/or other aspects and advantages will become apparent and more readily appreciated from the following description of the embodiments, taken in conjunction with the accompanying drawings in which.

DETAILED DESCRIPTION OF THE EMBODIMENTS

Figure 1:
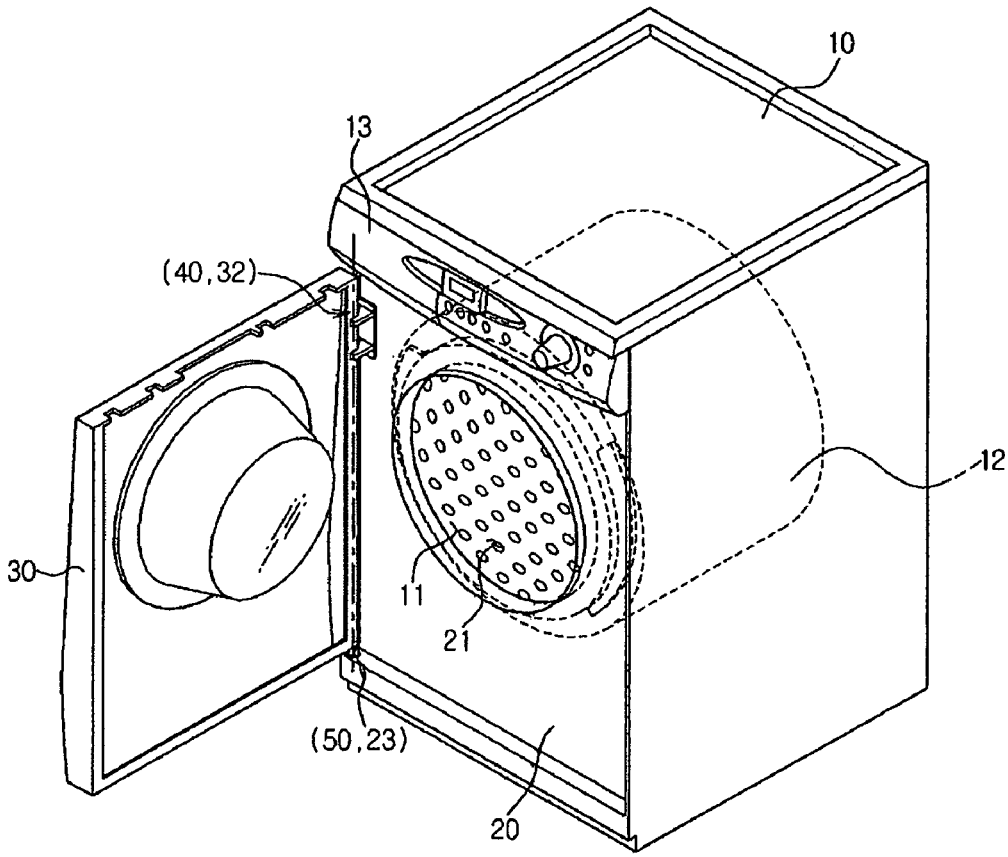
FIG. 1 is a perspective view illustrating a drum washing machine in accordance with the present embodiment.

Reference will now be made in detail to the embodiment, an example of which is illustrated in the accompanying drawings, wherein like reference numerals refer to like elements throughout. The embodiment is described below to explain the present invention by referring to the annexed drawings.

FIG. 1 is a perspective view illustrating a drum washing machine in accordance with the present embodiment.

With reference to FIG. 1, the drum washing machine in accordance with the present embodiment includes a housing 10 forming an external appearance of the washing machine, a tub 12 installed in the housing 10, a drum 11 rotatably installed in the tub 12, an opening 21 formed through the housing 10 to be connected to the drum 11, and a door 30 to open and close the opening 21. A control panel 13 to control the washing method and the washing process of laundry according to a kind and amount of the laundry is installed on an upper portion of the housing 10.

The housing 10 has a rectangular parallelepipedal shape, and the opening 21, through which laundry is put into the drum 11 or taken out of the drum 11, is formed through a front surface 20 of the housing 10. The door 30 rotated to open and close the opening 21 is hinged to the housing 10. Further, in order to improve the external appearance of the washing machine, when the door 30 closes the opening 21, the front surface 20 of the housing 10 is sunken to a designated depth so that the door 30 can be inserted into the housing 10 to the designated depth.

In designing the drum washing machine, the door 30 covers most of the front surface 20 of the housing 10, and thus has an increased size and weight. Thereby, a hinge structure to firmly endure the load of the door 30 and facilitate the connection of the door 30 to the housing 10 is required.

For this reason, a first hinge unit 40 and 32, which rotatably supports the door 30, is provided, and a second hinge unit 50 and 23, which is separated from the first hinge unit 40 and 32 and thus rotatably supports the door 30 together with the first hinge unit 40 and 32, is provided. The first hinge unit 40 and 32 supports an upper end of a left portion, for example, of the door 30, and the second hinge unit 50 and 23 supports a lower surface of the left portion of the door 30. Thus, the second hinge unit 50 and 23 axially supports the load of the door 30, thereby reducing the load transferred to a first hinge member 40.

Figure 2:
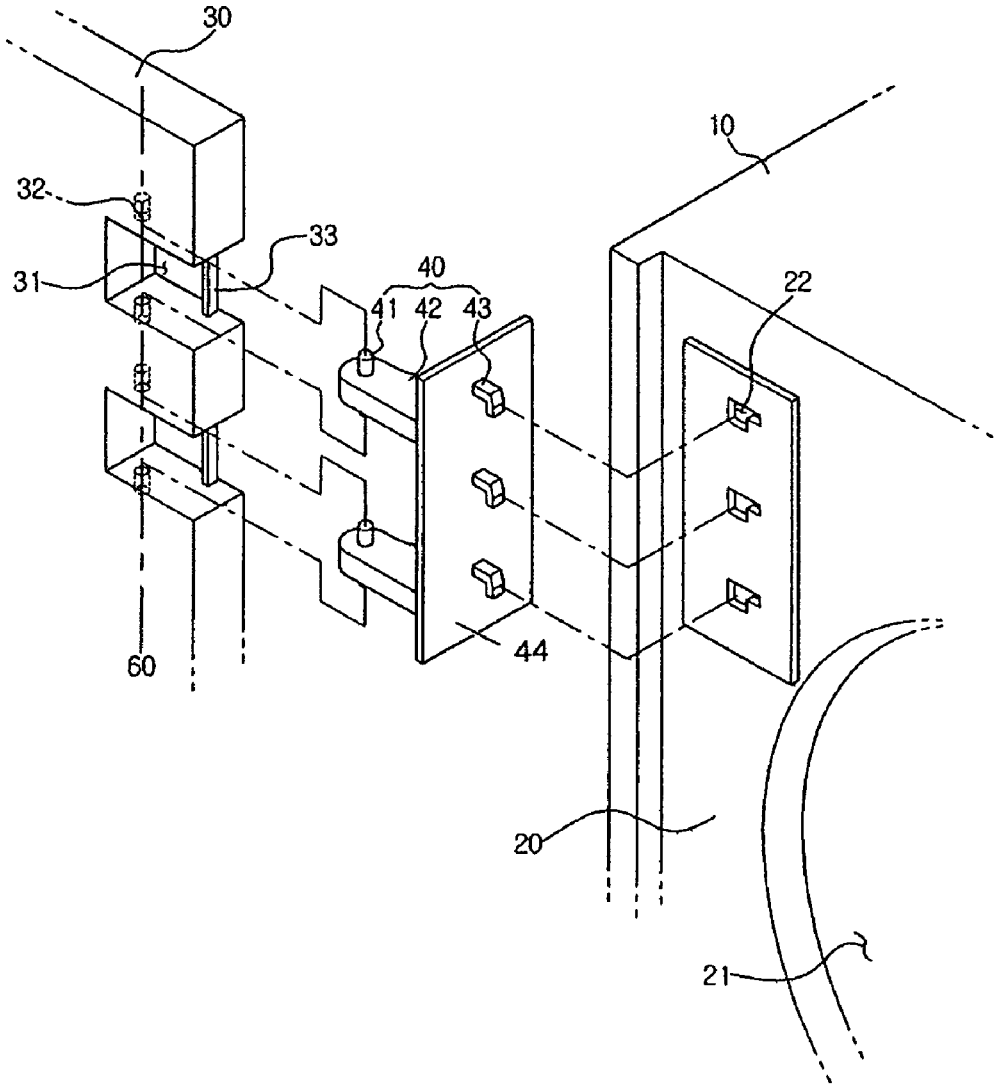
FIG. 2 is an exploded perspective view illustrating a first hinge unit of the drum washing machine in accordance with the present embodiment.

FIG. 2 is an exploded perspective view illustrating the first hinge unit 40 and 32 of the drum washing machine in accordance with the present embodiment.

With reference to FIG. 2, the first hinge unit 40 and 32 includes the first hinge member 40 forming an axis, and first hinge holes 32, into which parts of the hinge member 40 are respectively inserted, provided in the door 30. The first hinge member 40 includes a plurality of first hinge protrusions 41 connected to a rotary axis 60 of the door 30, first hinge bodies 42 connected to the first hinge protrusions 41 and fixed to the housing 10, and a plurality of first hinge hangers 43 protruded from a base hinge portion 44 to which the first hinge bodies 42 are fixed to fix the first hinge bodies 42 to the housing 10.

In order to prevent the door 30 from colliding with the first hinge bodies 42 while the door 30 is connected to the first hinge member 40 and is rotated, space formation parts 31 to form a designated space are provided in the door 30. The plurality of first hinge holes 32, into which the hinge protrusions 41 are respectively inserted, are formed in the door 30 along the rotary axis 60 of the door 30. The first hinge holes 32 are symmetrical with respect to the space formation parts 31.

A plurality of first hinge hanger grooves 22 to fix the first hinge member 40 to the housing 10 is formed in the housing 10. That is, the first hinge member 40 is fixed to the housing 10 by inserting the first hinge hangers 43 of the first hinge member 40 into the first hinge hanger grooves 22 formed in the housing 10.

A first opening restriction member 33, which is separated from the rotary axis 60 of the door 30 to adjust an opening angle of the door 30, is provided in each of the space formation parts 31 of the door 30. The first hinge bodies 42 of the first hinge member 40 connected to the door 30 are respectively located in the space formation parts 31. The first opening restriction members 33 and the first hinge bodies 42 are referred to as a first opening restriction unit 33 and 42 to restrict the opening angle of the door 30. Accordingly, if the door 30 is opened at a designated angle (θ1), the first opening restriction members 33 contact the first hinge bodies 42, and thus prevent the door 30 from being opened to more than the designated angle (θ1). This structure will be described in detail below, with reference to FIGS. 4 and 5.

Figure 3:
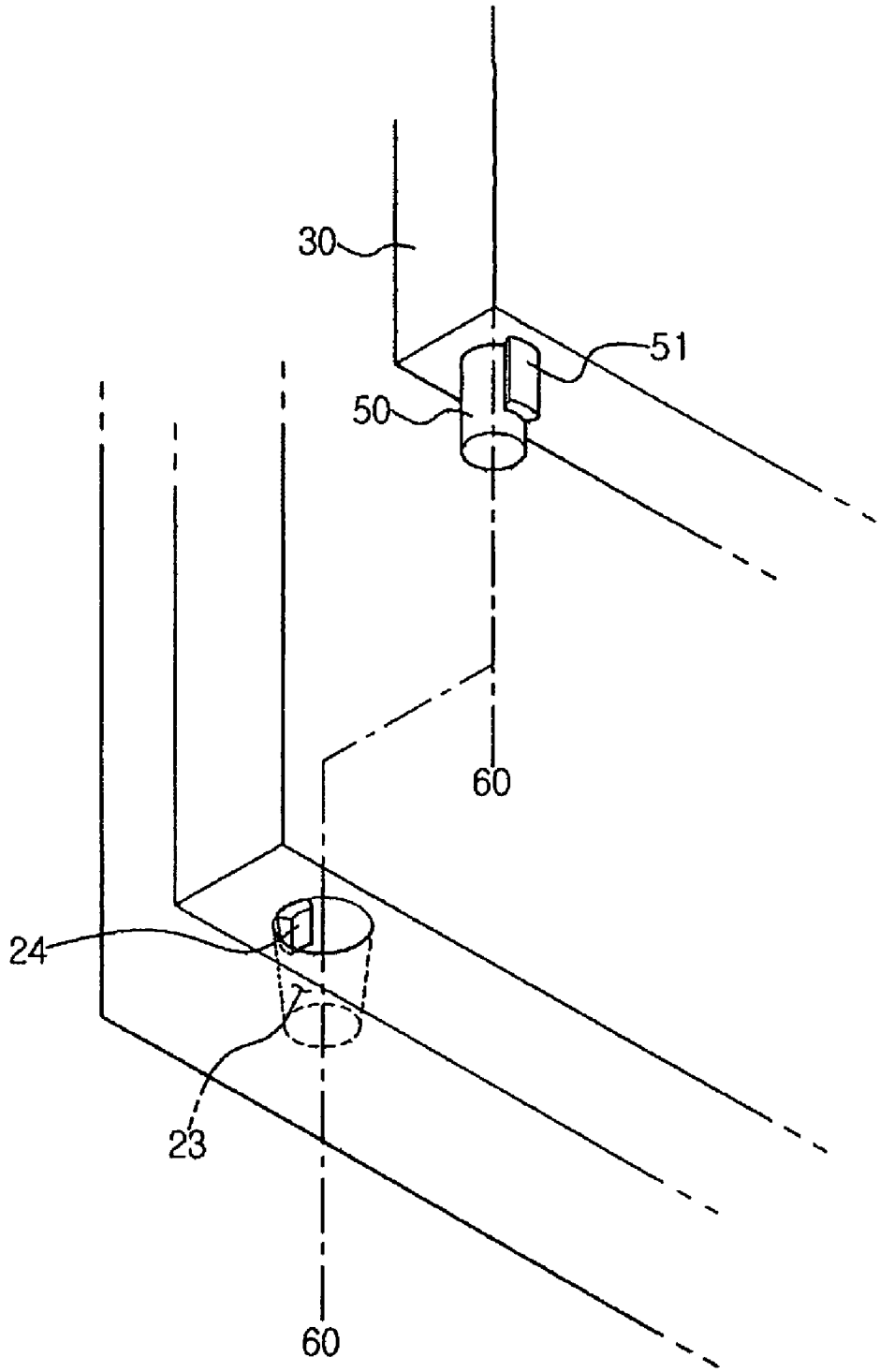
FIG. 3 is an exploded perspective view illustrating a second hinge unit of the drum washing machine in accordance with the present embodiment.

FIG. 3 is an exploded perspective view illustrating the second hinge unit of the drum washing machine in accordance with the present embodiment.

The second hinge unit 50 and 23 is separated from the first hinge unit 40 and 32, and thus rotatably supports the door 30 together with the first hinge unit 40 and 32. The second hinge unit 50 and 23 includes a second hinge protrusion 50 provided on a lower surface of a left portion of the door 30, and a second hinge hole 23 to support the second hinge protrusion 50 inserted thereinto. The second hinge protrusion 50 and the second hinge hole 23 are provided along the rotary axis 60 of the door 30.

The second hinge protrusion 50 is protruded from the lower surface of the door 30 in the direction toward the rotary axis 60 of the door 30. The hinge protrusion 50 has a cylindrical shape, and the second hinge hole 23 is formed in a lower portion of the housing 10 so that the second hinge protrusion 50 can be inserted into the second hinge hole 23 to support the door 30. The second hinge hole 23 has a designated depth, and is configured such that the inner diameter of the second hinge hole 23 is decreased from an upper portion thereof to a lower portion thereof (or the inner diameter of the second hinge hole 23 is increased from the lower portion thereof to the upper portion thereof).

Accordingly, even when the second hinge protrusion 50 is inserted into the second hinge hole 23, the door 30 can be tilted while fixing the tip of the second hinge protrusion 50 to the housing 10. Thus, the door 30 is easily hinged to the housing 10 by inserting the second hinge protrusion 50 into the second hinge hole 23 and then by easily inserting the first hinge hangers 43 (with reference to FIG. 2) into the first hinge hanger grooves 22 (with reference to FIG. 2).

Further, when the door 30 assembled with the housing 10 is repeatedly opened and closed, friction between the second hinge protrusion 50 and the second hinge hole 23 occurs. The friction may damage the second hinge protrusion 50. Therefore, a cap is put on the second hinge protrusion 50, which thus minimizes the friction of the second hinge protrusion 50 with the second hinge hole 23.

A second opening restriction unit 51 and 24 to restrict an opening angle of the door 30 is provided on the second hinge unit 50 and 23. The second opening restriction unit 51 and 24 includes a second opening restriction member 51 and a second hinge hanger 24. The second opening restriction member 51 is provided on a side surface of the second hinge protrusion 50. That is, the second opening restriction member 51 is protruded from the side surface of the second hinge protrusion 50. The second hinge hanger 24 is protruded from a side surface of the second hinge hole 23. The second opening restriction member 51 is formed integrally with the second hinge protrusion 50, and the second hinge hanger 24 is formed integrally with the housing 10.

In the case that the door 30 is opened to more than a designated angle (θ1) due to an excessive load applied to the door 30 under the condition that the door 30 is opened at the designated angle (θ1), the second opening restriction member 51 contacts the second hinge hanger 24, and thus prevents the door 30 from being damaged due to a collision with the housing 10. This structure will be described in detail below, with reference to FIGS. 4 and 5.

In the drum washing machine of the present embodiment, in order to prevent the door 30 from colliding with the housing 10, the first opening restriction unit 33 and 42 is provided on the first hinge unit 40 and 32 and the door 30, the second opening restriction unit 51 and 24 is provided on the second hinge unit 50 and 23, or both the first opening restriction unit 33 and 42 and the second opening restriction unit 51 and 24 are provided.

Hereinafter, the first opening restriction unit 33 and 42 and the second opening restriction unit 51 and 24 are referred to as opening restriction units 33, 42, 51, and 24, both the first opening restriction unit 33 and 42 and the second opening restriction unit 51 and 24 are provided, and a sequential restriction of the opening angle of the door 30 by the first opening restriction unit 33 and 42 and the second opening restriction unit 51 and 24 will be described in detail.

Figure 4:
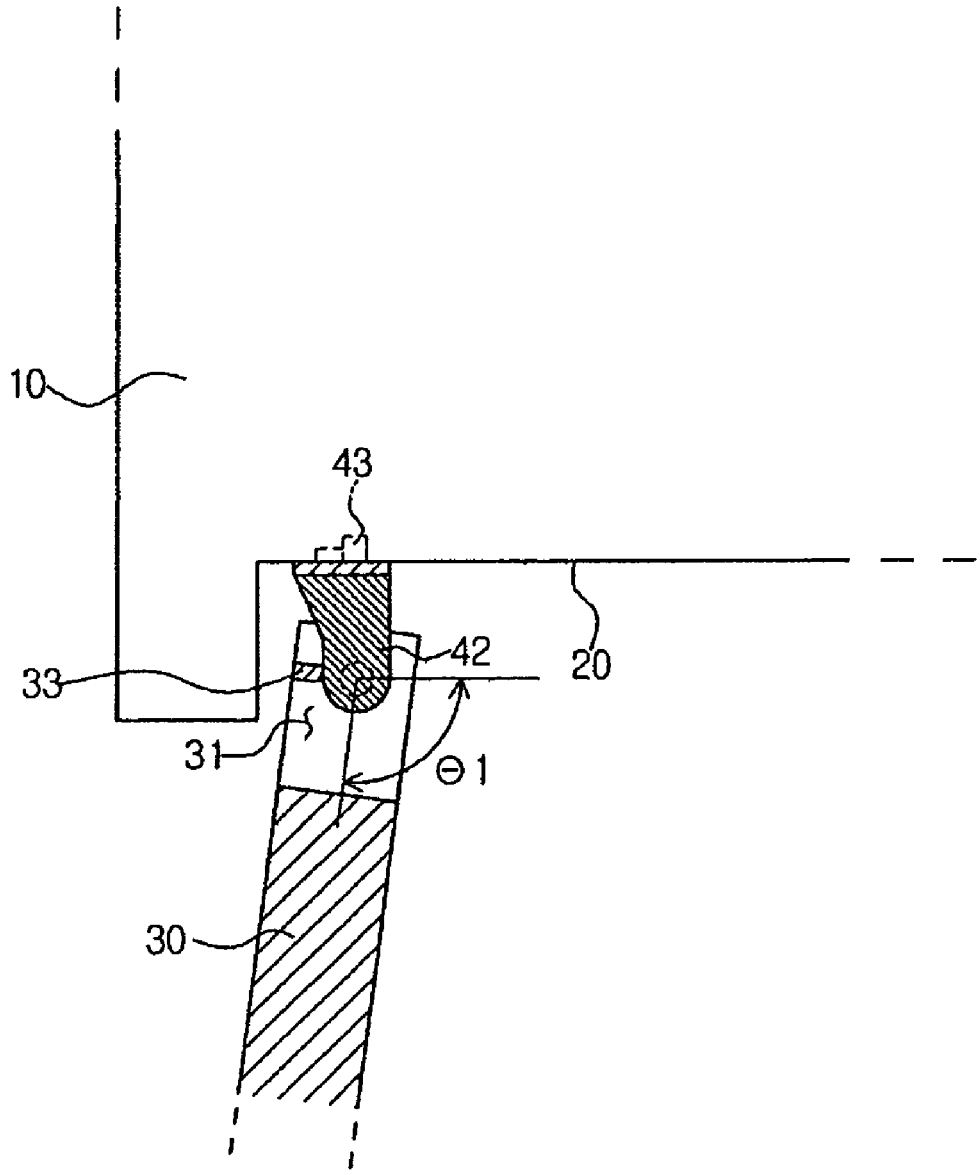
FIG. 4 is a sectional view illustrating a door in an opened state and a first opening restriction unit provided on the upper portion of the drum washing machine in accordance with the present embodiment.

FIG. 4 is a sectional view illustrating the door in an opened state and the first opening restriction unit provided on the upper portion of the drum washing machine in accordance with the present embodiment.

Figure 5:
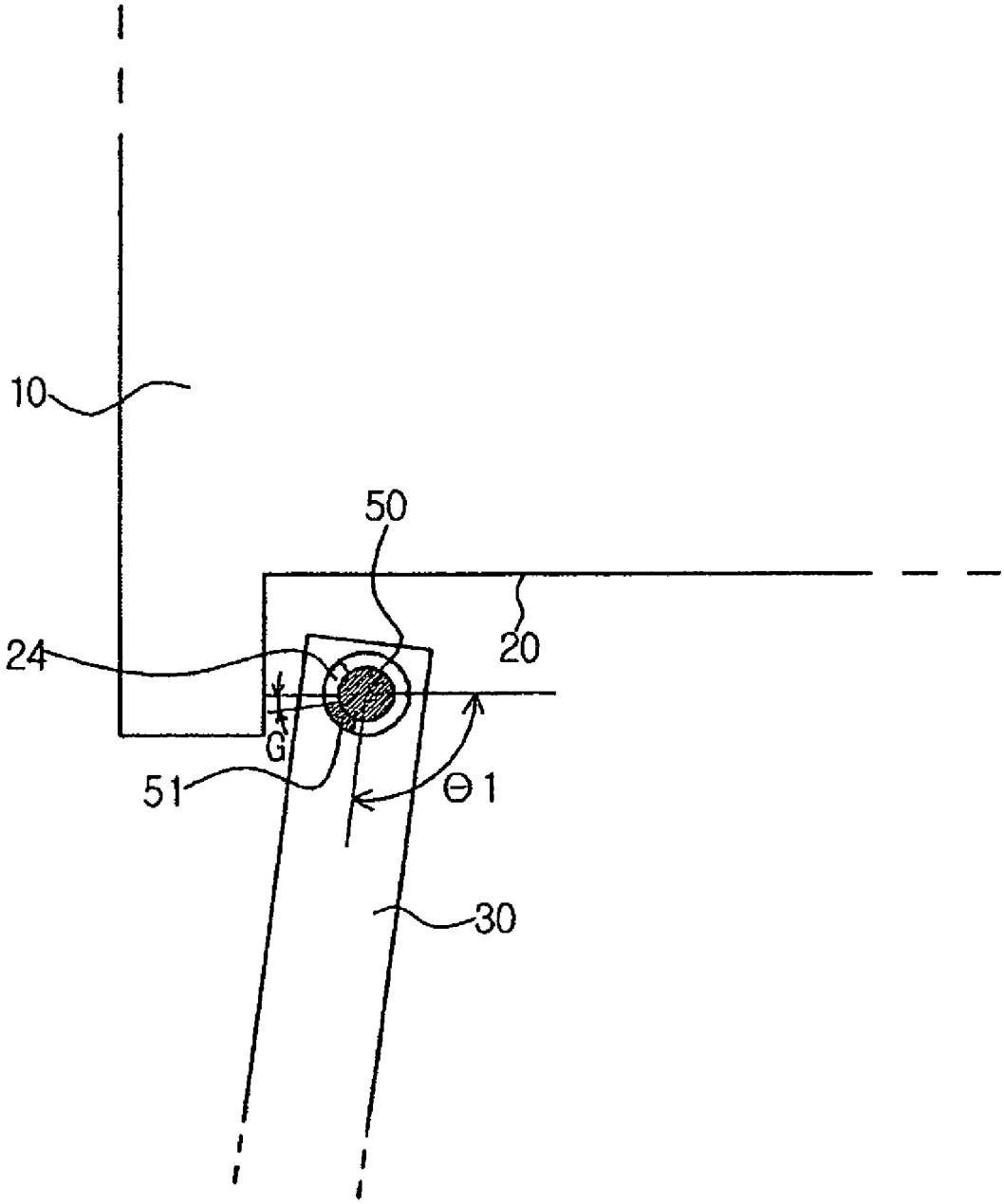
FIG. 5 is a sectional view illustrating the door in the opened state and a second opening restriction unit provided on the lower portion of the drum washing machine in accordance with the present embodiment.

FIG. 5 is a sectional view illustrating the door in the opened state and the second opening restriction unit provided on the lower portion of the drum washing machine in accordance with the present embodiment.

With reference to FIG. 4, if the door 30 is opened at a designated angle (θ1), the first opening restriction members 33 provided in the space formation parts 31 of the door 30 are supported by the first hinge bodies 42. Thereby, the door 30 is not opened to more than the designated angle (θ1), and thus it is possible to prevent the door 30 from being damaged due to a collision with the housing 10.

With reference to FIG. 5, if the door 30 is opened at a designated angle (θ1), there is a designated interval (G) between the second opening restriction member 51 provided on the second hinge protrusion 50 and the second hinge hanger 24 provided on the second hinge hole 23. That is, the designated interval (G) between the second opening restriction member 51 and the second hinge hanger 24 allows the first opening restriction unit 33 and 42 and the second opening restriction unit 51 and 24 to sequentially restrict the opening angle of the door 30.

Generally, due to the structural shapes of the first hinge unit 40 and 32 and the second hinge unit 50 and 23 to hinge the door 30 to the housing 10 (i.e., the position of the second hinge unit 50 and 23 on the lower surface of the door 30), the second hinge protrusion 50 has a weaker rigidity than that of the first hinge member 40. In the case that the door 30 is opened at the designated angle (θ1) under the condition that there is no designated interval (G) between the second opening restriction member 51 and the second hinge hanger 24, when the second hinge hanger 24 and the second opening restriction member 51 contact each other, torsion is applied to the second hinge protrusion 50, and thus the second hinge protrusion 50 may be easily damaged.

Accordingly, in the present embodiment, when the door 30 is opened at the designated angle (θ1), the second opening restriction member 51 does not contact the second hinge hanging member 24, thus preventing the second hinge protrusion 50 having a weak structure from being damaged.

Further, if that the door 30 is opened to more than the designated angle (θ1) due to a user's excessive force, the second opening restriction member 51 contacts the second hinge hanger 24, thus preventing the door 30 from being damaged due to a collision with the housing 10.

As apparent from the above description, the present embodiment provides a drum washing machine in which a worker may easily assemble a door with a housing, thus increasing a working efficiency.

The drum washing machine of the present embodiment reduces load transferred to a first hinge unit of the door to prevent the first hinge unit from being twisted and damaged, and prevents the door from being tilted to effectively open and close the door.

The drum washing machine of the present embodiment allows a first opening restriction unit and a second opening restriction unit to sequentially restrict the opening angle of the door, thus preventing a second hinge protrusion from being damaged.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A drum washing machine, comprising:

a housing provided with a rectangular front surface at which an opening through which laundry is put into the washing machine is formed;

a door connected to the housing to open and close the door, the door having a rectangular shape corresponding to the rectangular front surface of the housing to cover the front surface of the housing;

a first hinge unit connecting an upper end of the rectangular door to the housing to enable the housing to rotatably support the upper end of the rectangular door; and a second hinge unit provided between a lower end of the rectangular door and the housing to enable the housing to rotatably support the lower end of the rectangular door, wherein the rectangular door includes a first side adjacent to the first hinge unit, a second side opposite to the first side, an upper surface connecting an upper end of the first side and an upper end of the second side, and a lower surface connecting a lower end of the first side and a lower end of the second side, wherein the housing includes a supporting surface disposed to face the lower surface of the door, and wherein the second hinge unit includes a hinge protrusion extending downwardly from the lower surface of the rectangular door, and a hinge hole provided at the supporting surface of the housing such that the hinge protrusion is inserted into the hinge hole and a load of the door is supported on the supporting surface of the housing.

2. The drum washing machine according to claim 1, wherein an inner diameter of the hinge hole is increased from a lower portion thereof to an upper portion thereof so that the door can be tilted when being attached to the housing by inserting the hinge protrusion into the hinge hole.

3. The drum washing machine according to claim 1, wherein the first hinge unit includes hinge protrusions connected to a rotary axis of the door, hinge bodies connected to the hinge protrusions and fixed to the housing, hinge hangers formed in the hinge bodies to fix the hinge bodies to the housing, hinge hanger grooves formed in the housing to fix the hinge hangers to the housing by inserting the hinge hangers thereinto to securely lock with the hinge hangers, and hinge holes formed in the door to support the hinge protrusions inserted thereinto.

4. The washing machine according to claim 1, wherein the first hinge unit includes a plurality of hinge bodies separated in the vertical direction and hinged to the rectangular door.

5. The drum washing machine according to claim 1, wherein at least one of the first hinge unit and the second hinge unit includes an opening restriction unit restricting an opening angle of the door, the opening restriction unit including a first opening restriction unit and a second opening restriction unit, the first and second opening restriction units respectively restricting the opening angle of the door within different ranges.

6. A drum washing machine, comprising:

a housing provided with a rectangular front surface at which an opening through which laundry is put into the washing machine is formed;

a door connected to the housing to open and close the door, the door having a rectangular shape corresponding to the rectangular front surface of the housing to cover the front surface of the housing;

a hinge member rotatably connecting an upper end of the rectangular door to the housing, and including a plurality of hinge bodies arranged in the vertical direction with respect to each other, hinged to the upper end of the rectangular door through first hinge protrusions; and a second hinge protrusion protruding from a lower surface of the rectangular door and hinged to the housing to enable the housing to rotatably support the lower end of the rectangular door;

wherein the housing includes a supporting surface disposed to face the lower surface of the door, and wherein the second hinge protrusion extends downwardly from the lower surface of the rectangular door, and a hinge hole provided at the supporting surface of the housing such that the second hinge protrusion is inserted into the hinge hole and a load of the door is supported on the supporting surface of the housing.

7. The drum washing machine according to claim 6, further comprising:

an opening restriction unit restricting an opening angle of the door, the opening restriction unit including a first opening restriction unit and a second opening restriction unit, the first and second opening restriction units respectively restricting the opening angle of the door within different ranges.

8. The drum washing machine according to claim 7, wherein the first opening restriction unit is provided at a side of the door and includes first opening restriction members provided on the door, and the first opening restriction members contact the hinge bodies to restrict the opening angle of the door when the door is opened at a designated angle.

9. The drum washing machine according to claim 7, wherein the second opening restriction unit includes a second opening restriction member provided on outer surface of the second hinge protrusion to restrict the opening angle of the door and a hinge hanger provided on inner surface of the hinge hole to contact the second opening restriction member when the door is rotated.

10. The drum washing machine according to claim 9, wherein the second opening restriction member is formed integrally with the second hinge protrusion, and the hinge hanger is formed integrally with the hinge hole.

11. The drum washing machine according to claim 9, wherein the first opening restriction unit restricts the opening angle of the door to a designated angle, and when the door is opened at the designated angle, there is a designated interval between the second opening restriction member and the hinge hanger.

12. A drum washing machine, comprising:

a housing provided with a rectangular front surface at which an opening through which laundry is put into the washing machine is formed;

a door connected to the housing to open and close the door, the door having a rectangular shape corresponding to the rectangular front surface of the housing to cover the front surface of the housing;

a first hinge unit connecting an upper end of the rectangular door to the housing to enable the housing to rotatably support the upper end of the rectangular door, the first hinge unit including hinge bodies separated in the vertical direction, first hinge protrusions provided on the hinge bodies, and first hinge holes provided on the door such that the first hinge protrusions are inserted into the first hinge holes; and a second hinge unit provided between a lower end of the rectangular door and the housing to enable the housing to rotatably support the lower end of the rectangular door, wherein the housing includes a supporting surface disposed to face the lower surface of the door, and wherein the second hinge unit includes a second hinge protrusion extends downwardly from a lower surface of the rectangular door and a second hinge hole is provided at the supporting surface of the housing such that the second hinge protrusion is inserted into the second hinge hole and a load of the door is supported on the supporting surface of the housing.

13. The drum washing machine according to claim 12, further comprising:

at least one opening restriction unit provided at at least one of the first hinge unit and the second hinge unit, the at least one opening restriction unit restricting an opening angle of the door, wherein the at least one opening restriction unit includes a first opening restriction unit and a second opening restriction unit, the first opening restriction unit and the second opening restriction unit sequentially restricting the opening angle of the door.

14. The drum washing machine according to claim 13, wherein the first opening restriction unit restricts the opening angle of the door to a designated angle and the second opening restriction unit restricts the opening angle of the door when a user forces the door to open to more than the designated angle so that the door is prevented from colliding with the housing.

* * * * *